US011906219B2

(12) United States Patent
Winandy et al.

(10) Patent No.: US 11,906,219 B2
(45) Date of Patent: Feb. 20, 2024

(54) FLASH TANK-BASED CONTROL OF REFRIGERANT INJECTION INTO A COMPRESSOR

(71) Applicant: Emerson Climate Technologies GmbH, Berlin (DE)

(72) Inventors: Eric Winandy, Esneux (BE); Remi Dickes, Aachen (DE); Paolo Chiaramonte, Belluno (IT); Luca Mazzorana, Belluno (IT)

(73) Assignee: Copeland Europe GmbH, Berlin (DE)

( * ) Notice: Subject to any disclaimer, the term of this patent is extended or adjusted under 35 U.S.C. 154(b) by 38 days.

(21) Appl. No.: 17/238,126

(22) Filed: Apr. 22, 2021

(65) Prior Publication Data

US 2021/0348813 A1 Nov. 11, 2021

(30) Foreign Application Priority Data

Apr. 24, 2020 (EP) ..... 20171276

(51) Int. Cl.
*F25B 43/00* (2006.01)
*F25B 13/00* (2006.01)

(52) U.S. Cl.
CPC ..... *F25B 43/006* (2013.01); *F25B 13/00* (2013.01)

(58) Field of Classification Search
CPC ..... F25B 43/006; F25B 13/00
See application file for complete search history.

(56) References Cited

U.S. PATENT DOCUMENTS

| | | | | |
|---|---|---|---|---|
| 10,371,127 | B1 * | 8/2019 | Hurtado | F03G 7/06 |
| 2014/0208785 | A1 | 7/2014 | Wallace et al. | |
| 2017/0167762 | A1 * | 6/2017 | Kato | F25B 13/00 |
| 2017/0174049 | A1 * | 6/2017 | He | F25B 49/02 |
| 2018/0156513 | A1 * | 6/2018 | Javerschek | F25B 1/10 |
| 2018/0363954 | A1 * | 12/2018 | Zhao | F25B 41/24 |
| 2020/0124330 | A1 | 4/2020 | Hayes | |

FOREIGN PATENT DOCUMENTS

| | | | | |
|---|---|---|---|---|
| EP | 2730859 | A1 | 5/2014 | |
| WO | WO-2008130357 | A1 * | 10/2008 | F25B 1/10 |
| WO | WO-2011112495 | A2 * | 9/2011 | F25B 9/008 |
| WO | WO-2013016403 | A1 * | 1/2013 | F25B 1/10 |

OTHER PUBLICATIONS

Extended European Search Report regarding Application No. 20171276.7 dated Oct. 2, 2020.

* cited by examiner

*Primary Examiner* — Larry L Furdge
*Assistant Examiner* — Keith Stanley Myers
(74) *Attorney, Agent, or Firm* — Harness, Dickey & Pierce, P.L.C.

(57) ABSTRACT

A refrigeration cycle may include a compressor and a flash tank. The flash tank is configured for receiving a refrigerant and separating liquid refrigerant and vapour refrigerant. The compressor is configured for compressing the refrigerant and includes a suction port and an injection port. The flash tank is connected to the injection port of the compressor via an injection valve. A method of controlling injection into the compressor includes determining a pressure in the flash tank and controlling the injection valve based on the determined pressure in the flash tank.

12 Claims, 10 Drawing Sheets

FLASH TANK-BASED CONTROL OF REFRIGERANT INJECTION INTO A COMPRESSOR

CROSS-REFERENCE TO RELATED APPLICATIONS

This application claims priority to European Patent Application No. 20171276.7, filed on Apr. 24, 2020. The entire disclosure of which is incorporated herein by reference.

FIELD

The present patent application relates to a method for controlling refrigerant injection into a compressor in a refrigeration cycle, wherein the refrigeration cycle comprises an injection compressor and a flash tank.

BACKGROUND

Refrigeration systems having a refrigeration cycle are well known in the art. In a common refrigeration cycle, a refrigerant is circulated through a refrigeration system, in which it undergoes changes in thermodynamic properties in different parts of the refrigeration system. The refrigerant is a fluid, i.e. a liquid or a vapour or a gas, respectively. Examples of refrigerants may be artificial refrigerants like fluorocarbons. However, in recent applications, the use of carbon dioxide, $CO_2$, which is a non-artificial refrigerant, has become more and more important, because it is non-hazardous to the environment. The changes in thermodynamic properties of the refrigerant may, for example, include changes in temperature, pressure, volume, or enthalpy, wherein sometimes the changes in one property may also affect at least one other property, or wherein in some cases at least one property may stay constant while another property is changing. The changes in thermodynamic properties may go along with phase transitions of at least a portion of the refrigerant, for example from liquid to vapour and vice versa.

The refrigerant is used in a refrigeration system for transporting heat in a refrigeration cycle. Thereby, heat is usually transported from one point in the refrigeration cycle to another point in the refrigeration cycle by ease of the refrigerant. For example, these points in the refrigeration cycle may be represented by heat exchangers. In a first heat exchanger, the refrigerant may accept heat from a source. The source may be, for example, the air of a room the temperature of which shall be controlled. After being transported to a second heat exchanger, the refrigerant may reject heat in the second heat exchanger, for example, by transferring heat to exhaust air.

Nowadays, refrigeration systems are of particular importance for controlling temperature or climate conditions. A particular type of a refrigeration system is a compression refrigeration system, which sometimes is referred to as vapour compression refrigeration system (VCRS).

As used herein, a refrigeration cycle comprises at least a compressor for compressing the refrigerant. Compressing the refrigerant may drive the cycle. Further, such a refrigeration cycle commonly comprises a heat exchanger, in which heat may be extracted from the compressed refrigerant. The extraction of heat from the compressed refrigerant is sometimes referred to as heat rejection, because heat is rejected from the refrigeration system. Accordingly, this heat exchanger often is referred to as heat rejection heat exchanger. Further, such a refrigeration cycle commonly comprises an expansion device, in which the pressure and thereby the temperature of the refrigerant are reduced. The expansion device may be, for example, a valve, in particular an expansion valve, or a metering device. In addition, such a refrigeration cycle commonly comprises another heat exchanger, which may be used for accepting heat from a source. The other heat exchanger is often referred to as heat accepting heat exchanger. The heat accepting heat exchanger is in fluid communication with the compressor, so that the refrigerant is guided to the compressor in order to close the cycle.

In some refrigeration cycles, a compressor is used for driving the refrigeration cycle. Such a compressor commonly comprises a suction port and a discharge port, as well as a means for compressing. The suction port is configured for receiving refrigerant from the refrigeration cycle. For example, the refrigerant may be received from the heat accepting heat exchanger. The suction port is in fluid communication with the compression chamber for at least a first time instance for providing the refrigerant to the means for compressing. In the means for compressing, the refrigerant will be compressed to a desired pressure. The compression in general increases the pressure of the refrigerant. This may go along with an increase in temperature of the refrigerant. In case the compressor may be a scroll compressor, the means for compressing may be formed by the scroll set of the scroll compressor.

The means for compressing is in fluid communication with the discharge port of the compressor for at least a second time instance for providing the compressed refrigerant to the discharge port. At the discharge port, the compressed refrigerant may be discharged from the compressor at a desired discharge pressure or desired discharge temperature.

In some refrigeration cycles, the compressor may be an injection compressor. Additionally to the aforementioned features of a compressor, an injection compressor comprises an injection port. The injection port is in fluid communication with a source for providing refrigerant. A source may be, for example, an economizer. Further, the injection port is in fluid communication with the means for compressing of the compressor for at least a third time instance. In case that the injection port is in fluid communication with the means for compressing, refrigerant is provided from the source to the means for compressing of the compressor. The refrigerant, which is provided from the source to the means for compressing, may be referred to as additional refrigerant, injected refrigerant, or fresh refrigerant. In most applications, the injected refrigerant is in a vapour state. However, in particular circumstances, it may be beneficial to inject liquid refrigerant additionally to the vapour refrigerant—for example, in a case, in which the temperature of the refrigerant in the compressor needs to be reduced.

In general, the efficiency of the system, which is represented by a so-called coefficient of performance (COP), depends on the temperature or pressure difference between the refrigerant in the heat rejection heat exchanger and the temperature or pressure of the refrigerant in the heat accepting heat exchanger. However, injection conditions, like pressure and temperature, have a direct influence on the efficiency of the system. Therefore, controlling the refrigerant system based only on the temperature of the refrigerant in the heat rejection heat exchanger may result in inefficient operation or in fluctuations of the cooling, which is provided by the refrigeration system. Hence, there is a need in the art for improving the efficiency of refrigeration systems.

This need is overcome by the method for controlling injection into a compressor of a refrigeration cycle according to the presented invention.

In general, the presented invention relates to a method for controlling injection into a compressor of a refrigeration cycle based on the pressure in a flash tank of the refrigeration cycle, wherein the flash tank is connected at least to the injection port of the injection compressor.

A method of controlling injection into a compressor in a refrigeration cycle according to the invention is performed in a refrigeration cycle, which comprises at least a flash tank configured for receiving a refrigerant and separating liquid refrigerant and vapour refrigerant, and a compressor configured for compressing the refrigerant. The compressor comprises a means for compressing, a suction port and an injection port, at wherein least the injection port is connected to the means for compressing for at least a certain time instance. The means for compressing is configured for receiving a refrigerant from the suction port and/or the injection port of the compressor. Further, the means for compressing compresses the refrigerant. In a preferred embodiment, the compressor may be a scroll compressor and the means for compressing may be formed by a scroll set of the scroll compressor. Further, the compressor may also comprise a discharge port and the means for compressing may be configured for providing the compressed refrigerant to the discharge port of the compressor.

Since the present invention deals with the control of the refrigerant in the refrigerant cycle of the refrigerant system, the term connected is used to describe a connection, which enables a fluid communication via this connection. In other words, the connection enables the exchange of refrigerant between the connected entities.

According to the present invention, the flash tank is connected to the injection port of the compressor. Said connection between the flash tank and the injection port is established via an injection valve. The flash tank is configured to separate vapour refrigerant and liquid refrigerant. The connection between the flash tank and the injection port is configured to provide vapour refrigerant from the flash tank to the injection port of the compressor. Said vapour refrigerant may be fresh refrigerant used for injection into the compressor, in particular into a means for compressing of the compressor.

The method according to the invention comprises determining a pressure in the flash tank. Determining the pressure in the flash tank may be performed continuously, periodically, or triggered by a specific event. In this regard, a specific event may, for example, be a read operation issued by the method for controlling. Determining the pressure in the flash tank may comprise determining a particular pressure value in the flash tank or may comprise determining whether or not the pressure value exceeds or underruns a threshold. Further, determining the pressure in the flash tank may also comprise determining a parameter, which is associated with the pressure.

In a preferred embodiment, the inlet of the flash tank may comprise an expansion device or may be connected to an expansion device within the refrigeration cycle. The respective expansion device may be used for expanding the refrigerant, thereby reducing its pressure. The expansion of the refrigerant may go along with flash evaporation. Flash evaporation refers to the generation of vapour during the expansion of a saturated liquid. In the flash tank, vapour refrigerant and liquid refrigerant may be separated in the same volume within the flash tank. For example, the liquid refrigerant may be collected at the bottom of the volume, while the vapour refrigerant is collected at the top. In this case, determining the pressure in the flash tank, may comprise determining the pressure in the volume, in which liquid refrigerant and vapour refrigerant are collected. However, in an example, the flash tank may collect the vapour refrigerant and the liquid refrigerant in separated chambers. For example, the flash tank may comprise at least one chamber for collecting vapour refrigerant and at least one other chamber for collecting liquid refrigerant. In such a case, determining the pressure in the flash tank may comprise any of determining the pressure within at least one chamber for collecting vapour refrigerant and determining the pressure within at least one chamber for collecting liquid refrigerant.

SUMMARY

According to the invention, the method further comprises controlling the injection valve based on the determined pressure in the flash tank. Controlling the injection valve may comprise adjusting the amount of injected refrigerant.

Controlling the injection valve thereby may comprise opening or closing the injection valve or partially opening or closing the injection valve. In this regard, partially opening or closing the injection valve may comprise determining an opening degree of the injection valve and setting the injection valve to said opening degree. The opening degree may be represented by a percentage, wherein 100% may refer to a fully opened injection valve and 0% may refer to a fully closed injection valve.

In the refrigeration system in which the method according to the invention is performed, the control may be performed by a controller within the system. For this purpose, the controller may be connected to the component, which is controlled. The connection between the controller and other components, such as the injection valve, the compressor and/or the flash tank is configured to exchange information. The controller may perform the step of controlling the injection valve by transmitting one or more control signals to the injection valve. The control signal may cause a valve to close or open. Further, the controller may also provide additional control signals, which cause a read operation for determining the pressure in the flash tank.

The controller may be connected to at least one sensor, wherein the sensor is configured to determine a pressure. The at least one sensor may be integrated in the flash tank. In an example, the sensor may be configured to determine the pressure in the flash tank and to provide the determined pressure to the controller. In another example, the sensor may be configured to provide data to the controller, wherein the controller is configured to determine the pressure in the flash tank from the data provided by the sensor. In any case, the controller is configured to determine whether and how to perform the controlling based on the determined pressure in the flash tank. For example, the controller may determine how to adjust the amount of injected refrigerant.

In a preferred embodiment, controlling the injection valve may comprise closing the injection valve, if the determined pressure in the flash tank is lower than a first threshold. The first threshold may be referred to as a minimum flash tank pressure for injection. The minimum flash tank pressure for injection may depend on the operating conditions of the compressor. In a preferred embodiment, the minimum flash tank pressure for injection is a pressure in the flash tank, which is necessary to provide efficient injection of fresh refrigerant into the compressor. In at least one embodiment, the minimum flash tank pressure for injection is selected to be greater than the pressure at the suction port of the compressor. For example, the minimum flash tank pressure for injection is based on internal characteristics of the compressor. Therefore, the minimum flash tank pressure for injection may be a compressor-specific value.

Further, controlling the injection valve may comprise at least partially opening the injection valve if the flash tank pressure is equal to or greater than the first threshold and may be lower than a second threshold. The second threshold is greater than the first threshold and may be a maximum flash tank pressure for refrigerant injection. If the pressure in the flash tank exceeds the maximum flash tank pressure for injection, the refrigerant would be injected into the compressor at a pressure, which is too high and may either harm the compressor or may result in a discharge pressure of the compressed refrigerant, which is too high and would lead to a reduced COP. Therefore, controlling the injection valve may also comprise closing the injection valve if the determined pressure in the flash tank is greater than the second threshold.

In at least some embodiments, opening the injection valve may comprise determining a value for an opening degree of the injection valve based on the determined flash tank pressure and setting the opening degree of the injection valve to the determined value. The determined value may be represented by a percentage. Further, the determining may be performed by a controller using a closed loop algorithm. Examples of closed loop algorithms may be a proportional integral derivative (PID) control algorithm, a fuzzy logic algorithm, or a Z-transformation. Accordingly, the controller, which may perform the determining, may be a PID controller, a fuzzy logic controller, or a Z-transformer. However, the person skilled in the art will be aware that other types of controllers may be used. The closed loop controller may be the controller, which performs the method according to the invention or may be a component within the controller, which performs the method according to the invention, or may be connected to said controller. Using a closed loop controller for the determining has the advantage that closed loop controllers usually are cheap and easy to implement and do not require high maintenance efforts.

In at least some of the aforementioned embodiments, opening of the injection valve is only carried out if it is determined that the compressor is operating. In these embodiments, the method may further comprise determining whether the compressor is operating. Determining whether the compressor is operating may comprise determining that the compressor is operating properly, which means that the compressor does not operate under a failure condition. In case that the compressor is not operating or not operating properly, the controller may also decide to close the injection valve.

In another preferred embodiment, the method may comprise determining a pressure at the injection port of the compressor. Further, the method may comprise determining whether the pressure at the injection port is greater than a third threshold. The third threshold may be a maximum injection pressure. If it is determined that the pressure at the injection port is greater than the third threshold, the method may comprise closing the injection valve and stopping the operation of the compressor. If the pressure at the injection port exceeds the maximum injection pressure, the pressure of the refrigerant, which is received by the compressor at the injection port, is already too high for allowing a proper injection into the compressor. Accordingly, this method step represents a safety regulation, because the operation of the compressor may be stopped in order to avoid damage to the compressor by increased pressure.

In another preferred embodiment, the method may further comprise controlling the compressor. Although the control may adjust the operation of the compressor, it needs to be appreciated that the operation of the compressor can also be adjusted by other control operations. For example, the operation of the compressor may be controlled by the pressure at the suction port of the compressor and in case that the flash tank pressure gets too high, the operation of the compressor may be adjusted based on the flash tank pressure.

Controlling the compressor may also comprise adjusting the operating condition of the compressor. The operating condition of the compressor may be determined by the capacity of the compressor. In this regard, the capacity of the compressor may, for example, be defined as the amount of compressed refrigerant provided per time interval. As the person skilled in the art will appreciate, adjusting the capacity of the compressor may be performed by adjusting the speed at which the compressor operates, since said adjusting is directly related to the amount of compressed refrigerant provided per time interval. For instance, the higher the speed at which the compressor operates, the higher the amount of compressed refrigerant provided by the compressor per time interval.

In a preferred embodiment, the method may comprise, if the determined flash tank pressure is lower than a fourth threshold, controlling the compressor may comprise determining an operating speed for the compressor and setting the operating speed to the determined operating speed. The fourth threshold may be referred to a flash tank pressure for compressor unloading.

If the determined flash tank pressure is equal or greater than the fourth threshold and lower than a fifth threshold, controlling the compressor may comprise unloading the compressor. Thereby, the fifth threshold may be equal to the second threshold, which may be referred to as maximum pressure for refrigerant injection. Unloading the compressor may comprise reducing the capacity of the compressor to a minimum. Although the capacity of the compressor is reduced to a minimum, the operation of the compressor is not stopped. According to the invention, the compressor is unloaded in the pressure range between the fourth threshold and the fifth threshold. In this pressure range, the unloading is performed regardless of the pressure at the suction port of the compressor.

If the determined flash tank pressure is greater than the fifth threshold, the method may further comprise stopping the operation of the compressor. This may improve the safe operation of the compressor, because the operation of the compressor is stopped if the flash tank pressure is too high, which would lead to too high injection pressures and may damage the compressor.

In another preferred embodiment, the compressor comprises a discharge port and the refrigeration cycle, in which the method is performed, further comprises a heat rejection heat exchanger, which is connected to the discharge port of the compressor, and a second expansion device disposed between the heat rejection heat exchanger and the flash tank. The second expansion device may be referred to as high pressure valve. The method may further comprise setting an opening degree of the second expansion device to a predetermined value, if the determined flash tank pressure is lower than a sixth threshold. The predetermined value may be determined based on the characteristics of the compressor, which is used in the refrigeration cycle. In one embodiment, the predetermined value may correspond to a fully opened second expansion device. The sixth threshold may be a minimum allowed flash tank pressure, which is necessary for proper operation of the flash tank. The predetermined value may be a value, which is known to provide acceptable performance of the refrigerant under standard conditions.

Further, the method may comprise setting the opening degree of the second expansion device to a value determined by a PID controller based on a first heat rejection heat exchanger pressure mode (HRHE_mode1), if the determined flash tank pressure is equal or greater than the sixth threshold and lower than a seventh threshold. The first heat rejection heat exchanger pressure mode represents a controlling of the second expansion device based on the temperature of the refrigerant in the heat rejection heat exchanger in order to reach desired pressure in the heat rejection heat exchanger and thereby a high COP. For example, the desired pressure may be a setpoint, which is specified by an operator or which is set during manufacturing, or an optimum pressure, which is associated with the optimum COP. The optimum pressure may depend on operating conditions of the compressor or other system characteristics like compressor efficiency or heat exchanger efficiency. The desired pressure may be determined by the controller. In one embodiment, the controller detects the outlet temperature of the refrigerant at heat rejection heat exchanger. Thereby, the controller may be configured to measure the temperature itself or may be configured to receive the temperature from a sensor. Based on the determined temperature at the outlet of the heat rejection heat exchanger, the controller adjusts the opening degree of the second expansion device in order to maintain a high pressure in the heat rejection heat exchanger, which optimizes the COP. The relation between the temperature of the refrigerant at the outlet of the heat rejection heat exchanger and the pressure of the refrigerant in the heat rejection heat exchanger depends at least in part on the thermodynamic characteristics of the refrigerant, which is used. For example, the pressure of the refrigerant in the heat rejection heat exchanger may depend on at least one of the following parameters: temperature of the refrigerant in the heat rejection heat exchanger, pressure of the refrigerant in the heat accepting heat exchanger, and injection pressure.

Further, the method may comprise setting the opening degree of the second expansion device to a value determined by the PID controller based on a second heat rejection heat exchanger pressure mode (HRHE_mode2), if the determined pressure in the flash tank is equal or greater than the seventh threshold and lower than an eighth threshold. The eighth threshold may be equal to the fourth threshold. The second heat rejection heat exchanger pressure mode represents a controlling of the second expansion device based on the temperature of the refrigerant in the heat rejection heat exchanger and the pressure of the refrigerant in the flash tank. Thereby, the second heat rejection heat exchanger pressure mode accounts for increasing flash tank pressure levels by reducing the opening degree of the second expansion device. This may reduce the flash tank pressure. Further, this may allow for achieving a flash tank pressure, which is suitable for injecting refrigerant into the compressor.

Further, the method may comprise controlling the opening degree of the second expansion device based on fuzzy regulation, if the determined flash tank pressure is equal or greater than the eighth threshold and lower than a ninth threshold. The ninth threshold may be equal to the second threshold.

Further, the method may comprise controlling the opening degree of the second expansion device based on a flash tank pressure regulation mode (FT_mode), if the determined pressure in the flash tank is equal or greater than the ninth threshold and lower than a tenth threshold. The tenth threshold may be referred to as maximum allowed flash tank pressure. The flash tank pressure regulation mode represents a controlling of the second expansion device based on the pressure of the refrigerant in the flash tank. Thereby, the flash tank pressure regulation mode takes into account the further increased flash tank pressure and regulates the second expansion device in order to receive a flash tank pressure suitable for injection. Since the flash tank pressure is higher than in the pressure ranges in which the second heat rejection heat exchanger pressure mode is used, the flash tank pressure is the dominant condition for the regulation.

Further, the method may comprise closing the second expansion device, if the determined pressure in the flash tank is equal or greater than the ninth threshold.

In another preferred embodiment, the refrigeration cycle, in which the method is performed, further comprises a so-called by-pass line, which is connected between the flash tank and the suction port of the compressor. Thereby, the by-pass line may be used to provide refrigerant from the flash tank to the compressor. In an example, the by-pass line may be connected to the vapour collecting chamber of the flash tank. Further, the by-pass line may comprise a by-pass valve. The by-pass valve may act to expand the refrigerant. Expanding the refrigerant by the by-pass valve may be used to reduce the pressure of the refrigerant. In these embodiments, the method may comprise closing the by-pass valve if the determined pressure in the flash tank is lower than an eleventh threshold. The eleventh threshold may be a minimum flash tank pressure for by-pass regulation.

Further, the method may comprise determining a value for an opening degree of the by-pass valve based on the determined flash tank pressure, if the determined flash tank pressure is equal or greater than the eleventh threshold and lower than a twelfth threshold. The twelfth threshold may be equal to the fourth threshold. The opening degree may be determined by a PID controller.

Further, the method may comprise opening the by-pass valve completely, if the determined flash tank pressure is equal or greater than the twelfth threshold and lower than a thirteenth threshold. The thirteenth threshold may be equal to the second threshold.

Further, the method may comprise setting an opening degree of the by-pass valve to a predetermined value, if the determined flash tank pressure is equal or greater than the twelfth threshold. Thereby, the predetermined value may be set by a user according to the characteristics of the refrigerant and the refrigerant system. In order to set a suitable value for the predetermined value, the predetermined value represents an opening degree for which the flash tank pressure is decreased without providing too high pressure to the suction port of the compressor.

The thresholds, which are described throughout this application, may be independent from the operating conditions of the refrigeration system in at least some embodiments. However, in other embodiments, at least one of the thresholds may be dependent on the operating conditions of the refrigeration system. For example, the third threshold may depend on at least one of the pressure of the refrigerant in the heat rejection heat exchanger, the pressure of the refrigerant in the heat accepting heat exchanger, or the ambient temperature. In this case, the controller, which performs the method according to the invention may comprise a logic for adaptively adjusting the third threshold based on the operating conditions of the refrigeration system. Since the third threshold may be the maximum injection pressure, a dependency of the third threshold on the operating conditions of the refrigeration system may improve the flexibility of the control, may result in a higher COP and increased reliability of the compressor, and may also protect the compressor from failure.

The following description and the annexed drawings set forth in detail certain illustrative aspects of the systems described above. These aspects are indicative, however, of but a few of the various ways in which the principles of various embodiments can be employed and the described embodiments are intended to include all such aspects and their equivalent.

In the drawings, like reference characters generally refer to the same parts throughout the different drawings. The drawings are not necessarily to scale, emphasis instead generally being placed upon illustrating the principles of the invention.

DRAWINGS

In the following description, various embodiments of the invention are described with reference to the following drawings, in which:

FIG. 1*a*, 1*b* show schematics of exemplary refrigeration systems for flash tank-based control of refrigerant injection into a compressor;

FIG. 2 shows a diagram of the influence of refrigerant injection on the optimum heat rejection heat exchanger pressure;

FIG. 3*a*, 3*b*, 3*c* show block diagrams of the inputs and outputs of controllers as may be used in connection with the present invention;

DETAILED DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Figure 1A:
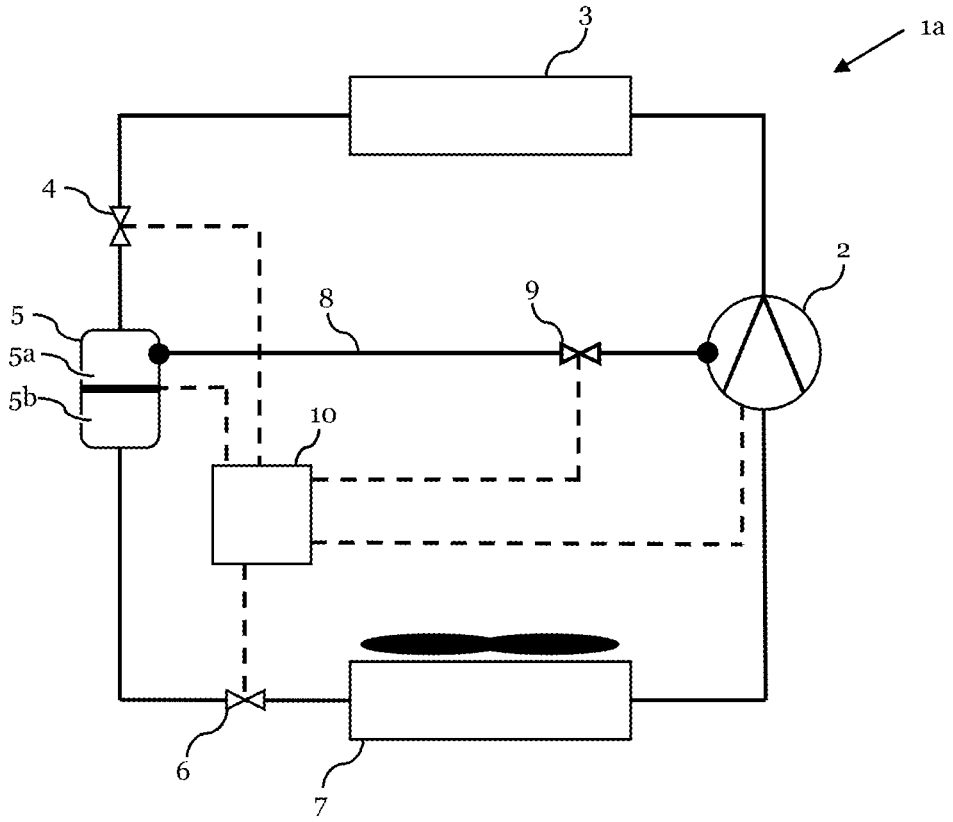

FIG. 1*a* shows a schematic of a refrigeration system 1*a* for flash tank-based control of refrigerant injection into a compressor 2 of the refrigeration system 1*a*. The refrigeration system 1*a* comprises a compressor 2, which comprises a suction port, a discharge port, and an injection port, a heat rejection heat exchanger 3 downstream of the compressor 2, a first expansion device 6 downstream of the heat rejection heat exchanger 3, and a heat accepting heat exchanger 7 downstream of the first expansion device 6 and upstream of the compressor 2.

Further, the refrigeration system 1*a* comprises a second expansion device 4 and a flash tank 5. The second expansion device 4 is disposed downstream of the heat rejection heat exchanger 3 and upstream of the first expansion device 6. The second expansion device 4 is used to expand the refrigerant after it exits the heat rejection heat exchanger 3. Thereby the pressure and the temperature of the refrigerant could be reduced.

The flash tank 5 is connected downstream of the second expansion device 4 and upstream of the first expansion device 6. In the refrigeration system 1*a* depicted in FIG. 1, the flash tank 5 comprises two separation chambers 5*a*, 5*b*. However, it would also be possible that the flash tank separates the liquid refrigerant and the vapour refrigerant in the same volume.

The two separation chambers 5*a*, 5*b* include a chamber 5*a* used for collecting vapour or flash gas and a chamber 5*b* for collecting liquid. Liquid collecting chamber 5*b* comprises at least one outlet. The connection between the flash tank 5 and the first expansion device 6 is established via at least one of the at least one outlets of the liquid collecting chamber 5*b* of the flash tank 5.

The vapour collecting chamber 5*a* of the flash tank 5 comprises at least one outlet. The at least one outlet of the vapour collecting chamber 5*a* is connected to an injection path 8, which connects the at least one outlet of the vapour collecting chamber 5*a* to the injection port of the compressor 2. The injection path 8 comprises an injection valve 9.

Further, the refrigeration system 1*a* comprises a controller 10, which is used for controlling at least one of the injection valve 9 and the compressor 2 based on the determined pressure in the flash tank 5. Further, the controller 10 may also control the first expansion device 6 and/or the second expansion device 4. FIG. 1*a* indicates the connection for exchanging control signals by ease of dashed lines. Although FIG. 1*a* shows dashed lines between the controller 10 and the injection valve 9, the first expansion device 6, the second expansion device 4, the compressor 2, and the flash tank 5, the person skilled in the art will appreciate that these dashed lines are shown for illustration purposes only. The controller 10 may be connected to any subset of the aforementioned components of the refrigeration cycle. With respect to the connection between the controller 10 and the flash tank 5, it is to be noted that the controller 10 may be connected to a sensor within the flash tank 5, wherein the sensor may be a pressure sensor. Furthermore, in some examples, multiple controllers may be employed in the refrigeration system. Each of these multiple controllers may control any subset of the expansion devices, the compressor, and the flash tank as is described before with respect to controller 10.

Figure 1B:
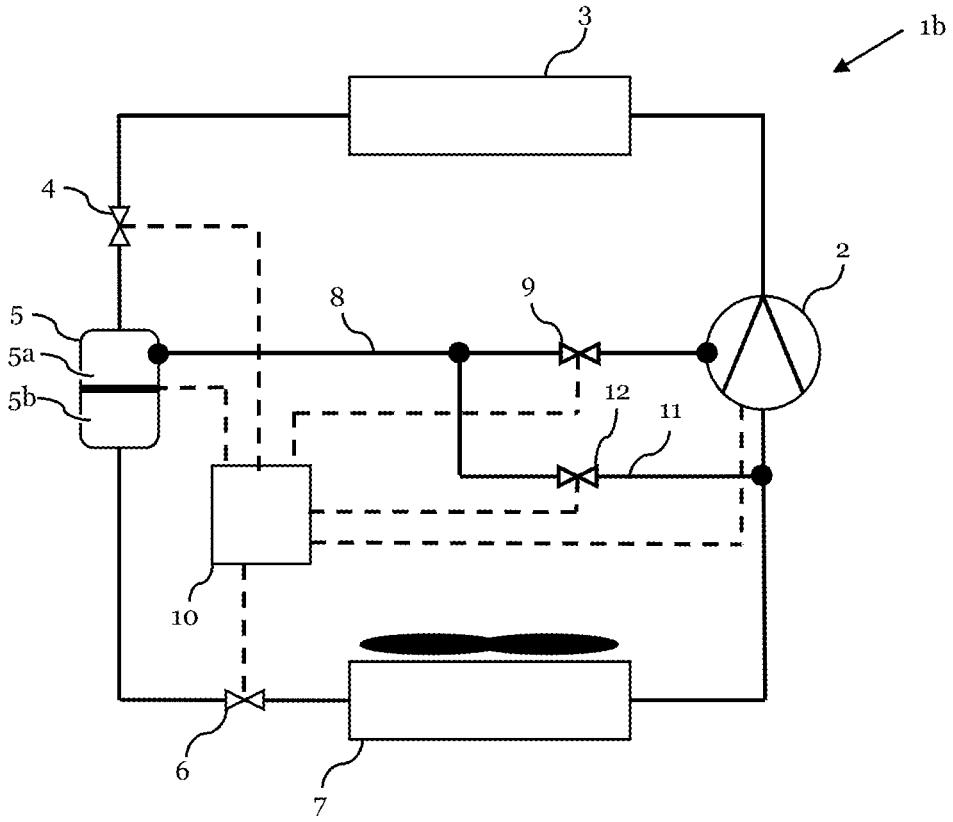

FIG. 1*b* shows a schematic of a refrigeration system 1*b* for flash tank-based control of refrigerant injection into a compressor 2 of the refrigeration system 1*b*. The refrigeration system 1*b* differs from the refrigeration system 1*a* in that a by-pass path 11 connects the injection path 8 between the flash tank 5 and the injection valve 9 to the suction port of the compressor 2. The by-pass path 11 comprises a by-pass valve 12. In another example, which is not depicted in the Figures, it may also be possible that the by-pass path 11 is connected directly to the flash tank 5. As is depicted in FIG. 1*b*, the controller 10 may also be configured to control the by-pass valve 12.

With respect to the refrigeration systems 1*a*, 1*b* depicted in FIGS. 1*a*, 1*b*, it needs to be noted that elements of the refrigeration systems 1*a*, 1*b*, which are depicted in FIGS. 1*a*, 1*b* or any other Figure of this application as individual components, may be included in the same housing or may form a component of the cycle, which is capable of performing the operations of the individual components depicted in FIG. 1*a*, 1*b*. As an example, the second expansion device 4 may be integrated into the flash tank 5. As such, there are multiple different configurations of combining or configuring the individual components depicted in FIGS. 1*a*, 1*b*. Also, it is possible to include additional components, which are not depicted in the embodiment examples.

Figure 2:
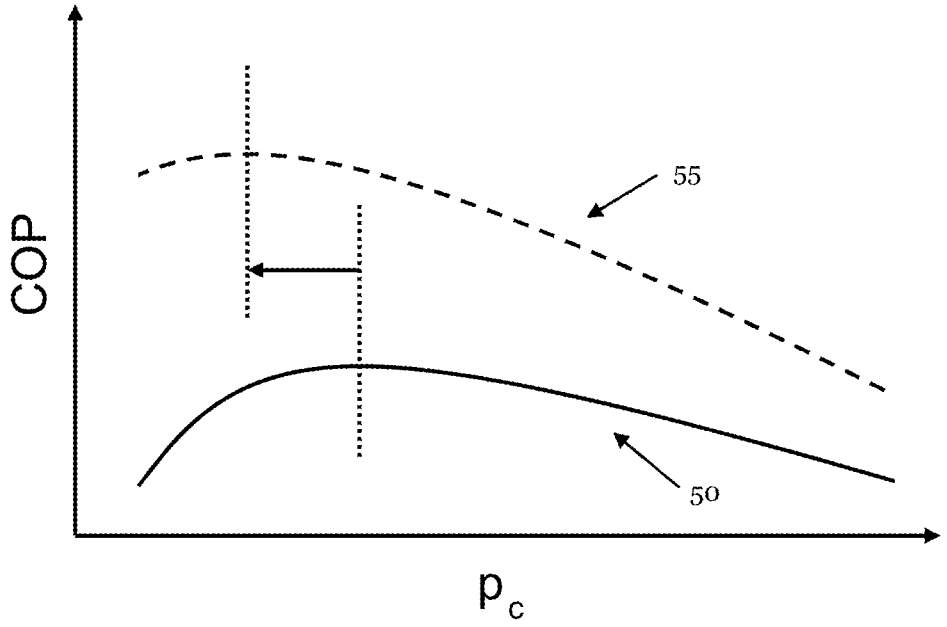

FIG. 2 shows a diagram of the influence of refrigerant injection on the optimum heat rejection heat exchanger pressure. In detail, FIG. 2 depicts the coefficient of performance (COP) depending on the pressure of the refrigerant in the heat rejection heat exchanger (pc). Thereby, solid line 50 represents the curve of the COP for a refrigeration system with closed injection valve, whereas dashed line 55 represents the curve of the COP for the same refrigeration system with opened injection valve. In a refrigeration system, the operating conditions are controlled in order to achieve the highest COP. Without refrigerant injection, the COP depends on the temperature of the refrigerant in the heat rejection heat exchanger. However, refrigerant injection has a direct influence on the efficiency of the system. This influence depends on the injection conditions, like pressure of the injected refrigerant or temperature of the injected refrigerant. As can be seen, injection does not only improve the overall COP. Injection also shifts the maximum of the COP to a lower pressure of the refrigerant in the heat rejection heat exchanger. The maximum of the respective curve represents the optimum heat rejection heat exchanger pressure. This optimum pressure is lower when injection of refrigerant into the compressor is used.

Figure 3A:
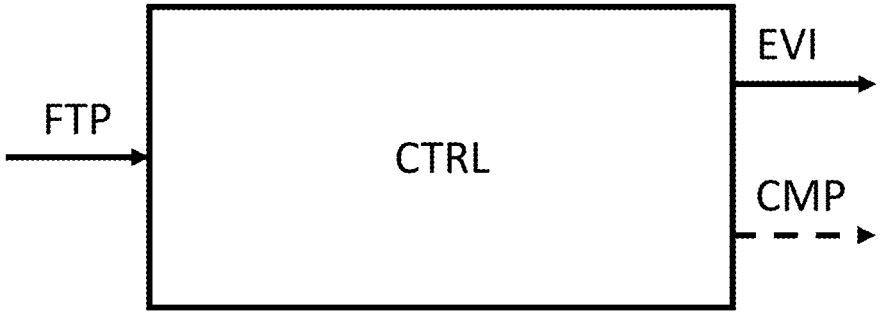
Figure 3B:
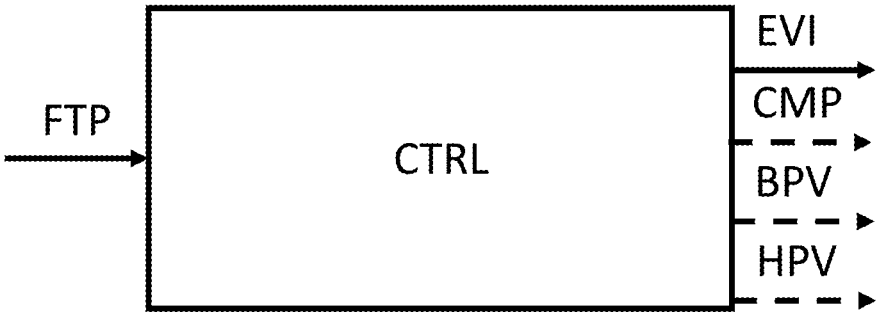
Figure 3C:
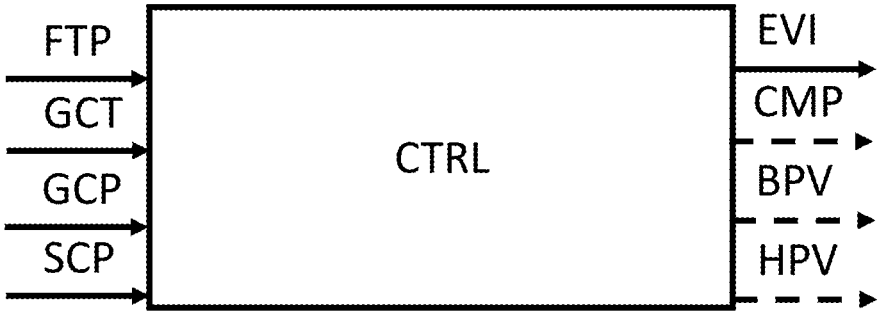

FIGS. 3*a*, 3*b*, 3*c* show block diagrams of the inputs and the outputs of controllers as may be used in connection with the present invention.

In FIG. 3*a*, the controller, which is represented by block "CTRL" receives the flash tank pressure as input and controls at least one of the injection valve EVI and the compressor CMP. In FIG. 3*a*, the output arrow of the compressor CMP is shown as dashed line in order to illustrate that the controller may perform injection valve control, compressor control, or both.

In FIG. 3*b*, the controller receives the flash tank pressure as input and controls at least one of the injection valve EVI, the compressor CMP, the by-pass valve, or the second expansion device HPV. Similarly to FIG. 3*a*, dashed lines indicate that the controller may output any combination of the four output controls.

In FIG. 3*c*, the controller receives the flash tank pressure, the temperature at the heat rejection heat exchanger GCT, the pressure at the heat rejection heat exchanger GCP, and pressure at the suction port SCP as inputs and controls at least one of the injection valve EVI, the compressor CMP, the by-pass valve, or the second expansion device HPV. Similarly to FIGS. 3*a*, 3*b*, dashed lines indicate that the controller may output any combination of the four output controls.

Figure 4:
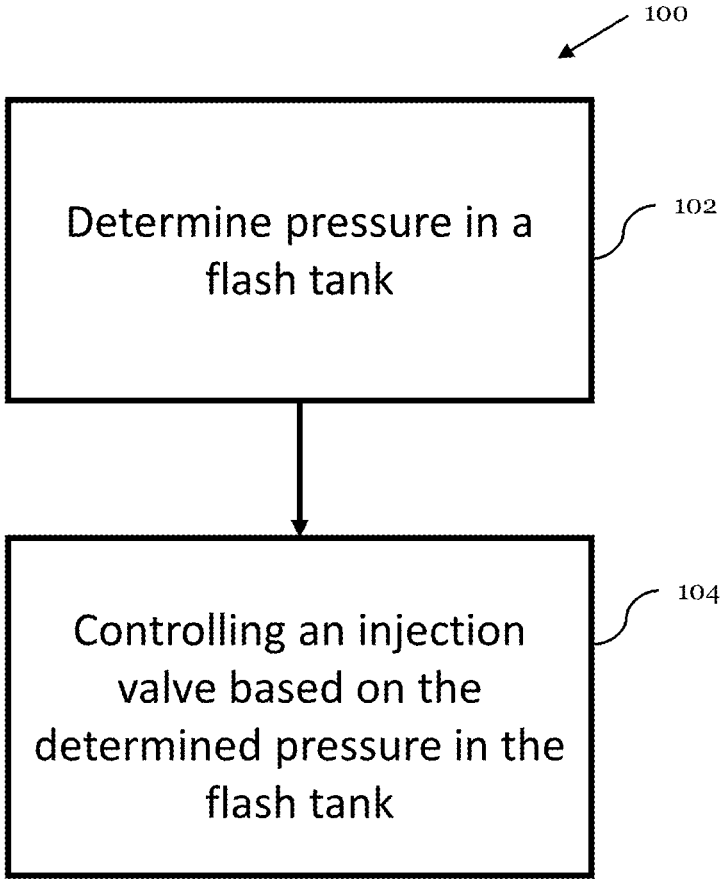
FIG. 4 shows a flow diagram of the method of controlling the injection into a compressor according to an embodiment of the invention.

FIG. 4 shows a flow diagram of the method of controlling the injection into a compressor according to an embodiment of the invention. The method 100 may be performed by a controller in a refrigeration cycle, for example controller 10 as depicted in FIGS. 1*a*, 1*b*. The method 100 comprises the step of determining 102 a pressure in a flash tank 5. Determining a pressure in the flash tank 5 may comprise determining a pressure in a vapour collecting chamber 5*a*.

Further, the method 100 comprises the step of controlling 104 an injection valve 9 based on the determined pressure in the flash tank 5.

Figure 5:
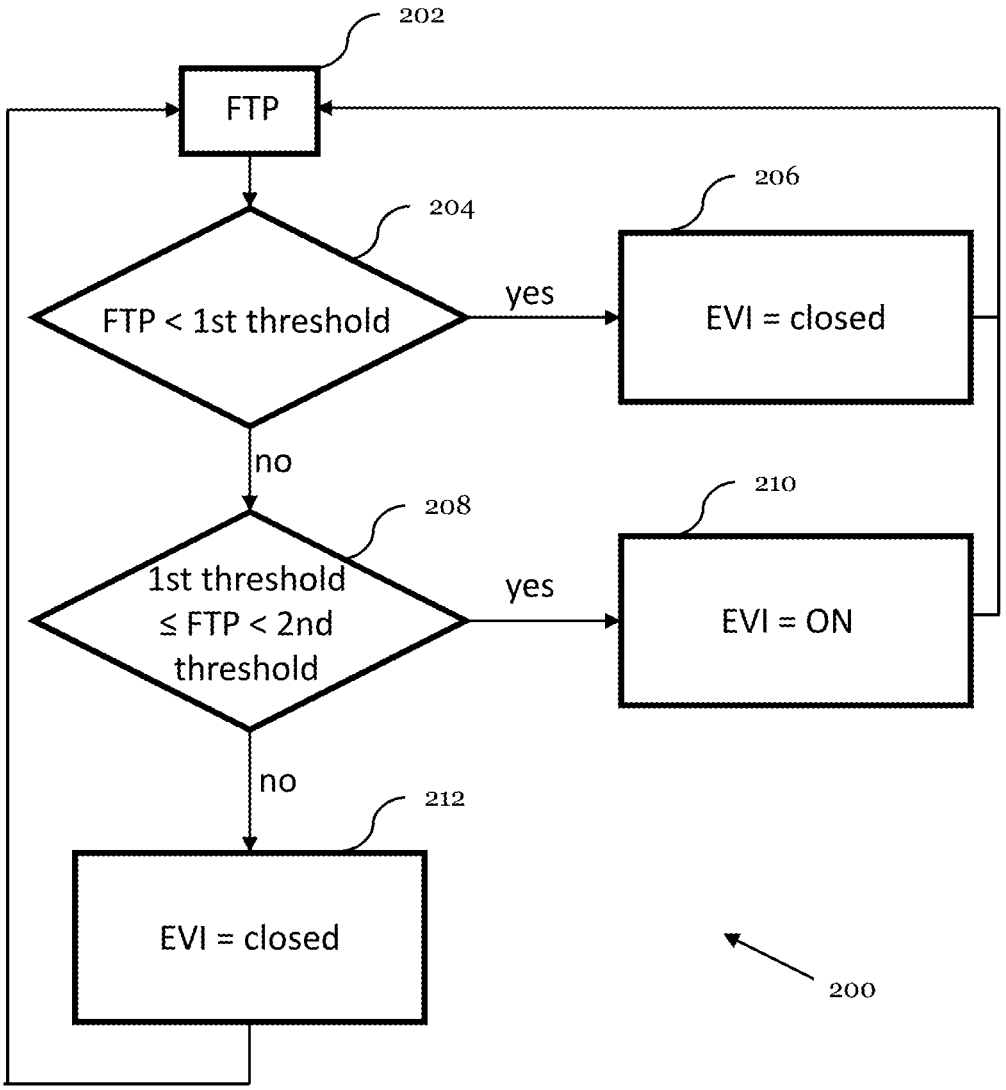
FIG. 5 shows a decision diagram of a preferred embodiment of a method of controlling the injection into a compressor, wherein the decision diagram relates to controlling the amount of injection into the compressor.

FIG. 5 shows a decision diagram 200 of a preferred embodiment of a method of controlling the injection into a compressor, wherein the decision diagram relates to controlling the amount of injection into the compressor. The amount of injection into the compressor is controlled by controlling the injection valve, which is referred to as EVI. The decision may be carried out by a controller, for example controller 10.

The method starts at step 202 where the flash tank pressure is determined or determined flash tank pressure is received. In FIG. 5, the flash tank pressure is referred to as FTP.

At step 204, it is determined whether the flash tank pressure is lower than a first threshold. In case that the pressure is lower than the first threshold, the method continues at step 206 where the injection valve EVI is closed. Otherwise, the method continues at step 208.

At step 208, it is determined whether the flash tank pressure is greater than or equal to the first threshold and lower than a second threshold. In case that the flash tank pressure is greater than or equal to the first threshold and lower than the second threshold, the method continues at step 210 where the injection valve EVI is opened. In an example, the injection valve EVI may be fully opened at step 210. In case that the flash tank pressure is not greater than or equal to the first threshold and lower than a second threshold, the method continues at step 212 where the injection valve EVI is closed.

In case the method reaches either one of steps 206, 210, or 212, the method may again continue at step 202 by determining or receiving a flash tank pressure FTP. In this case, the method may determine or receive an updated value for the flash tank pressure FTP.

Figure 6:
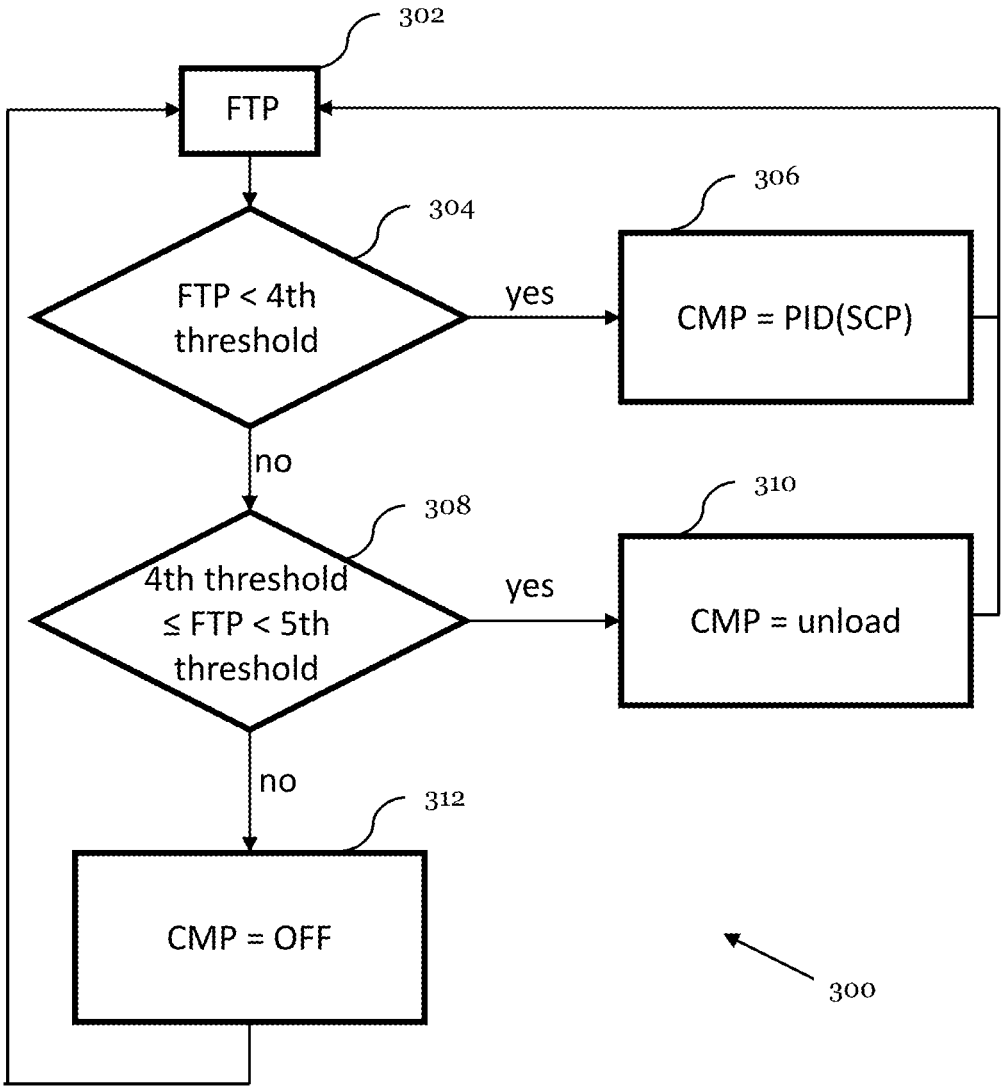
FIG. 6 shows a decision diagram of a preferred embodiment of a method of controlling the injection into a compressor, wherein the decision diagram relates to controlling the operation condition of the compressor.

FIG. 6 shows a decision diagram 300 of a preferred embodiment of a method of controlling the injection into a compressor, wherein the decision diagram relates to controlling the operating condition of the compressor. The operating condition of the compressor is referred to as CMP in FIG. 6. The decision may be carried out by a controller, for example controller 10.

The method starts at step 302 where the flash tank pressure is determined or determined flash tank pressure is received. In FIG. 6, the flash tank pressure is referred to as FTP.

At step 304, it is determined whether the flash tank pressure is lower than a fourth threshold. In case that the pressure is lower than the fourth threshold, the method continues at step 306 where the operating condition of the compressor is calculated by a PID controller based on the pressure at the suction port. Otherwise, the method continues at step 308.

At step 308, it is determined whether the flash tank pressure is greater than or equal to the fourth threshold and lower than a fifth threshold. If this is the case, the method continues at step 310 where the compressor is unloaded. Otherwise, the method continues at step 312 where the compressor stops its operation.

In case the method reaches either one of steps 306, 310, or 312, the method may again continue at step 302 by determining or receiving a flash tank pressure FTP. In this case, the method may determine or receive an updated value for the flash tank pressure FTP.

Figure 7:
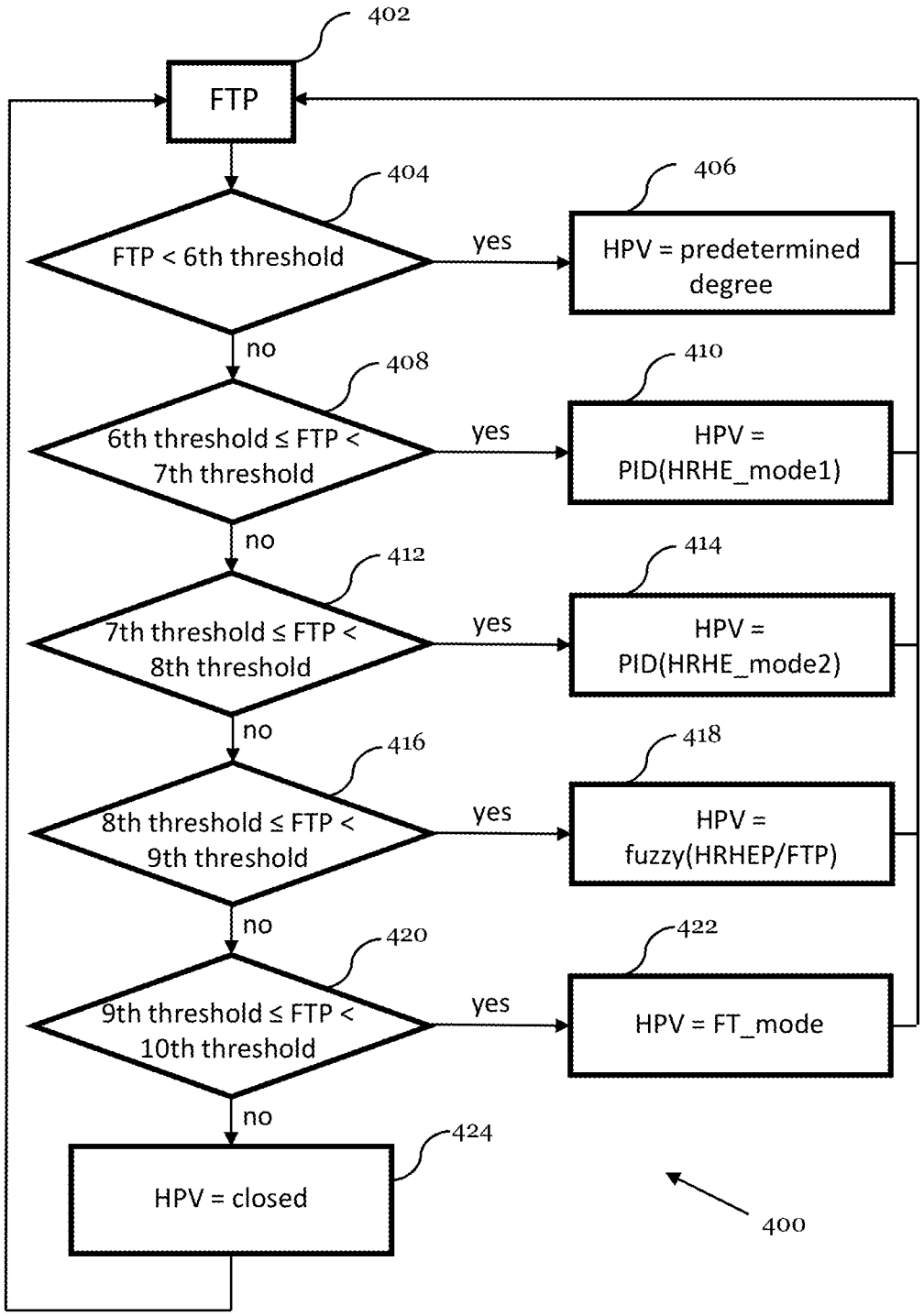
FIG. 7 shows a decision diagram of a preferred embodiment of a method of controlling the injection into a compressor, wherein the decision diagram relates to controlling a second expansion device, which is disposed between a heat rejection heat exchanger and the flash tank.

FIG. 7 shows a decision diagram 400 of a preferred embodiment of a method of controlling the injection into a compressor, wherein the decision diagram relates to controlling a second expansion device, which is disposed between a heat rejection heat exchanger and the flash tank. The second expansion device is referred to as high pressure valve HPV in FIG. 7. The decision may be carried out by a controller, for example controller 10.

The method starts at step 402 where the flash tank pressure is determined or determined flash tank pressure is received. In FIG. 7, the flash tank pressure is referred to as FTP.

At step 404, it is determined whether the flash tank pressure is lower than a sixth threshold. In case that the pressure is lower than the sixth threshold, the method continues at step 406 where the high pressure valve HPV is opened by a predetermined degree. The predetermined value may be determined based on the characteristics of the compressor, which is used in the refrigeration cycle. In one embodiment, the predetermined value may correspond to a fully opened second expansion device. The sixth threshold may be a minimum allowed flash tank pressure, which is necessary for proper operation of the flash tank. The predetermined value may be a value, which is known to provide acceptable performance of the refrigerant under standard conditions. Otherwise, the method continues at step 408.

At step 408, it is determined whether the flash tank pressure is greater than or equal to the sixth threshold and lower than a seventh threshold. In case that the flash tank pressure is greater than or equal to the sixth threshold and lower than the seventh threshold, the method continues at step 410 where the opening degree for the high pressure valve HPV is calculated by a PID controller based on a first heat rejection heat exchanger pressure mode (HRHE_mode1). The first heat rejection heat exchanger pressure mode represents a controlling of the second expansion device based on the temperature of the refrigerant in the heat rejection heat exchanger in order to reach optimum pressure in the heat rejection heat exchanger and thereby the optimum COP. In case that the flash tank pressure is not greater than or equal to the sixth threshold and lower than the seventh threshold, the method continues at step 412.

At step 412, it is determined whether the flash tank pressure is greater than or equal to the seventh threshold and lower than an eighth threshold. In case that the flash tank pressure is greater than or equal to the seventh threshold and lower than the eighth threshold, the method continues at step 414 where the opening degree for the high pressure valve HPV is calculated by a PID controller based on a second heat rejection heat exchanger pressure mode (HRHE_mode2). The second heat rejection heat exchanger pressure mode represents a controlling of the second expansion device based on the temperature of the refrigerant in the heat rejection heat exchanger and the pressure of the refrigerant in the flash tank. In case that the flash tank pressure is not greater than or equal to the seventh threshold and lower than the eighth threshold, the method continues at step 416.

At step 416, it is determined whether the flash tank pressure is greater than or equal to the eighth threshold and lower than a ninth threshold. In case that the flash tank pressure is greater than or equal to the eighth threshold and lower than the ninth threshold, the method continues at step 418 where the opening degree for the high pressure valve HPV is calculated by fuzzy regulation based on the pressure of the refrigerant in the heat rejection heat exchanger (HRHEP) and the flash tank pressure. Thereby, the pressure of the refrigerant in the heat rejection heat exchanger may be, for example, the pressure the refrigerant has at the outlet of the heat rejection heat exchanger or the pressure in the heat rejection heat exchanger. In case that the flash tank pressure is not greater than or equal to the eighth threshold and lower than the ninth threshold, the method continues at step 420.

At step 420, it is determined whether the flash tank pressure is greater than or equal to the ninth threshold and lower than a tenth threshold. In case that the flash tank pressure is greater than or equal to the ninth threshold and lower than the tenth threshold, the method continues at step 422 where the opening degree for the high pressure valve HPV is calculated based on a flash tank pressure regulation mode (FT_mode). The flash tank pressure regulation mode represents a controlling of the second expansion device based on the pressure of the refrigerant in the flash tank. In case that the flash tank pressure is not greater than or equal to the ninth threshold and lower than the tenth threshold, the method continues at step 424, where the high pressure valve HPV is closed.

In case the method reaches either one of steps 406, 410, 414, 418, 422, or 424, the method may again continue at step 402 by determining or receiving a flash tank pressure FTP. In this case, the method may determine or receive an updated value for the flash tank pressure FTP.

Figure 8:
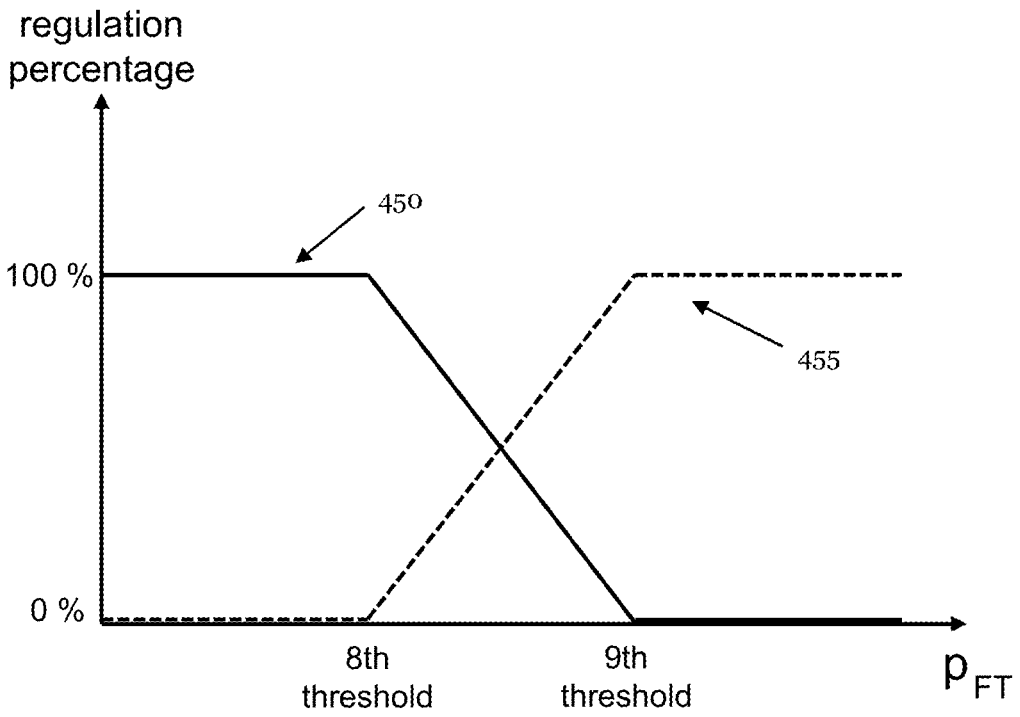
FIG. 8 shows a diagram representing the transition from second heat rejection heat exchanger pressure mode to flash tank pressure control mode for the second expansion device.

FIG. 8 shows a diagram representing an exemplary transition from the second heat rejection heat exchanger pressure mode to flash tank pressure control mode for the second expansion device. In detail, FIG. 8 depicts the regulation percentage between the second heat rejection heat exchanger pressure mode (HRHE_mode) and the flash tank pressure regulation mode (FT_mode). Thereby, solid curve 450 depicts the usage of the HRHE_mode2, whereas dashed curve 455 depicts the usage of the FT_mode. If the flash tank pressure is below the eighth threshold for the flash tank pressure, the control is based fully on the HRHE_mode2, according to step 414 of FIG. 7. Above the ninth threshold for the flash tank pressure, the control is based fully on the FT_mode, according to step 422 of FIG. 7.

If the flash tank pressure is between the eighth threshold and the ninth threshold, the control is performed based on a combination of the HRHE_mode2 and the FT_mode. This is represented by descending curve 450 and ascending curve 455. Thereby, the pressure stage between the eighth threshold and the ninth threshold corresponds to a transition zone from the HRHE_mode2 to the FT_mode. In this regard, it needs to be appreciated that the course of the curves 450, 455 in said transition zone is shown for illustrative purposes only. The course of the curves 450, 455 does not need to be linearly. Instead, the control may be performed based on fuzzy control, as is described with respect to step 418 of FIG. 7, which may lead to different courses of the curve 450, 455.

Figure 9:
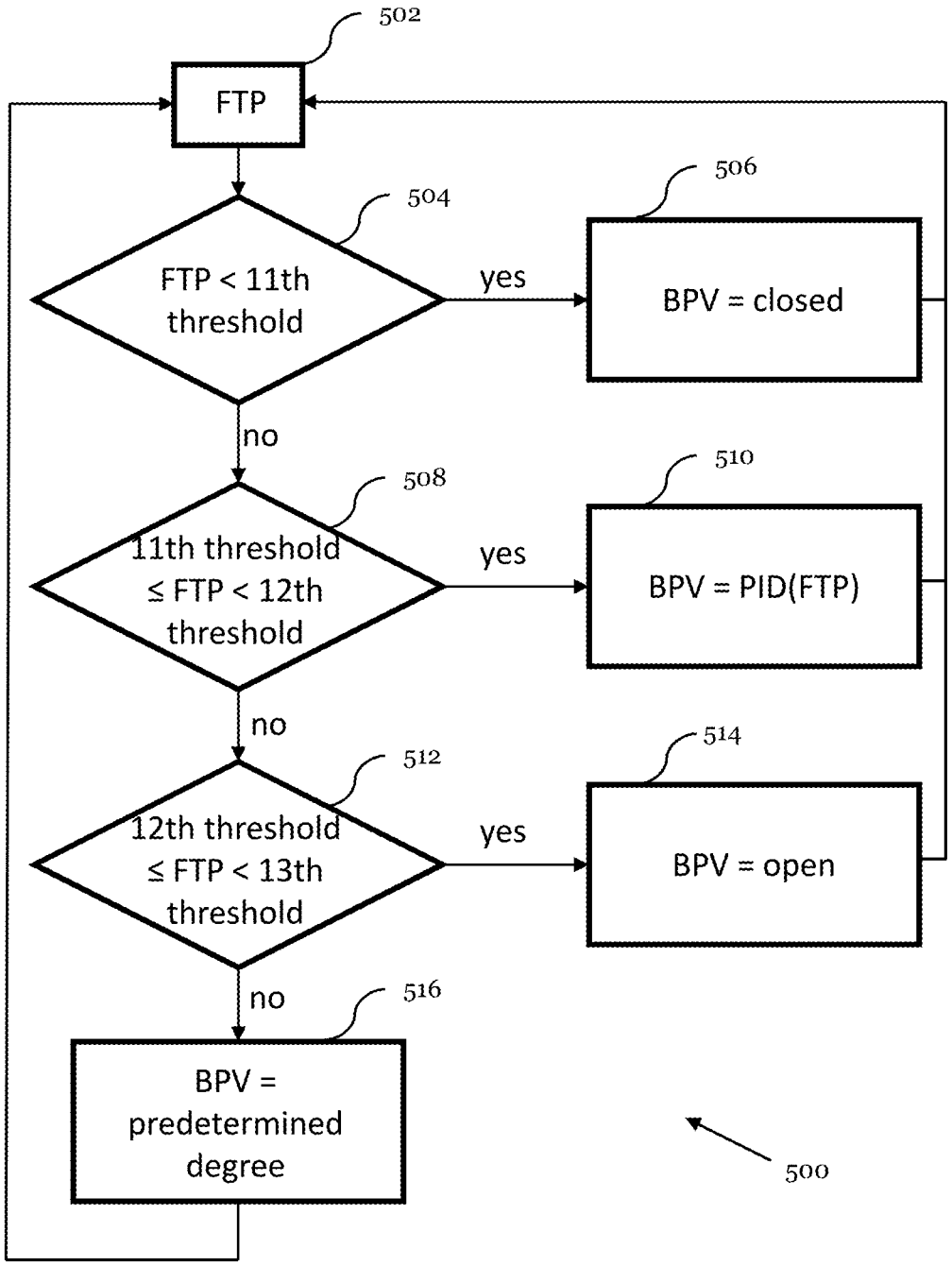
FIG. 9 shows a decision diagram of a preferred embodiment of a method of controlling the injection into a compressor, wherein the decision diagram relates to controlling a by-pass valve for by-passing refrigerant from the flash tank to the suction port of the compressor.

FIG. 9 shows a decision diagram 500 of a preferred embodiment of a method of controlling the injection into a compressor, wherein the decision diagram relates to controlling a by-pass valve for by-passing refrigerant from the flash tank to the suction port of the compressor. The by-pass valve is referred to as BPV in FIG. 7. The decision may be carried out by a controller, for example controller 10.

The method starts at step 502 where the flash tank pressure is determined or determined flash tank pressure is received. In FIG. 7, the flash tank pressure is referred to as FTP.

At step 504, it is determined whether the flash tank pressure is lower than an eleventh threshold. In case that the pressure is lower than the eleventh threshold, the method continues at step 506 where the by-pass valve BPV is closed. Otherwise, the method continues at step 508.

At step 508, it is determined whether the flash tank pressure is greater than or equal to the eleventh threshold and lower than a twelfth threshold. In case that the flash tank pressure is greater than or equal to the eleventh threshold and lower than the twelfth threshold, the method continues at step 510 where the opening degree for the by-pass valve BPV is calculated by a PID controller based on the flash tank pressure FTP. Otherwise, the method continues at step 512.

At step 512, it is determined whether the flash tank pressure is greater than or equal to the twelfth threshold and lower than a thirteenth threshold. In case that the flash tank pressure is greater than or equal to the twelfth threshold and lower than the thirteenth threshold, the method continues at step 514 where the by-pass valve BPV is fully opened. Otherwise, the method continues at step 516, where the opening degree for the by-pass valve is set to a predetermined value. The predetermined value may be set by a user according to the characteristics of the refrigerant and the refrigerant system. In order to set a suitable value for the predetermined value, the predetermined value represents an opening degree for which the flash tank pressure is decreased without providing too high pressure to the suction port of the compressor.

In case the method reaches either one of steps 506, 510, 514, or 516, the method may again continue at step 502 by determining or receiving a flash tank pressure FTP. In this case, the method may determine or receive an updated value for the flash tank pressure FTP.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the scope of the appended claims.

What is claimed is:

1. A method of controlling injection into a compressor in a refrigeration cycle, wherein the method is performed in a refrigeration cycle, which comprises at least a flash tank configured for receiving a refrigerant and separating liquid refrigerant and vapour refrigerant, and a compressor configured for compressing the refrigerant, wherein the compressor comprises a means for compressing, a suction port and an injection port, which is connected to the means for compressing for at least a time instance of the refrigeration cycle, wherein the flash tank is connected to the injection port of the compressor via an injection valve, the method comprising:

determining, via a sensor, a pressure in the flash tank;

controlling, via a controller, the injection valve based on the determined pressure in the flash tank; and controlling, via the controller, the compressor based on the determined pressure in the flash tank, wherein controlling the compressor comprises if the determined flash tank pressure is lower than a threshold, determining, by the controller, an operating speed for the compressor and setting the operating speed to the determined operating speed, wherein the threshold is referred to as a first threshold and wherein controlling the compressor comprises:

if the controller determines that the flash tank pressure is equal to or greater than the first threshold and lower than a second threshold, unloading the compressor; and if the controller determines that the flash tank pressure is greater than the second threshold, stopping operation of the compressor via the controller.

2. The method according to claim 1, wherein controlling the injection valve comprises:

if the determined pressure in the flash tank is lower than the second threshold, closing the injection valve.

3. The method according to claim 2, wherein controlling the injection valve comprises:

if the controller determines that the pressure in the flash tank is equal to or greater than the second threshold and lower than a third threshold, at least partially opening the injection valve.

4. The method according to claim 3, wherein opening the injection valve comprises:

determining, by the controller, a value for an opening degree of the injection valve based on the determined flash tank pressure; and setting the opening degree of the injection valve to the determined value.

5. The method according to claim 3, further comprising:

determining, via the controller, whether the compressor is operating; and wherein opening the injection valve is only carried out, if it is determined that the compressor is operating.

6. The method according to claim 3, wherein controlling the injection valve comprises:

if the controller determines that the pressure in the flash tank is greater than the third threshold, closing the injection valve.

7. The method according to claim 1, wherein the method further comprises:

determining, via another sensor, a pressure at the injection port of the compressor;

determining, via the controller, whether the pressure at the injection port is greater than the second threshold; and if it is determined that the pressure at the injection port is greater than the second threshold:

closing the injection valve via the controller; and turning off the compressor via the controller.

8. The method according to claim 1, wherein the compressor comprises a discharge port and wherein the refrigeration cycle further comprises a heat rejection heat exchanger, which is connected to the discharge port of the compressor, and an expansion device disposed between the heat rejection heat exchanger and the flash tank, wherein the method further comprises:

if the controller determines that the flash tank pressure is lower than a second threshold, setting an opening degree of the expansion device to a predetermined value;

if the controller determines that the flash tank pressure is equal to or greater than the second threshold and lower than a third threshold, setting the opening degree of the expansion device to a value determined by the controller based on a first heat rejection heat exchanger pressure mode;

determining, via the controller, that the pressure in the flash tank is equal to or greater than the third threshold and lower than a fourth threshold and setting the opening degree of the expansion device to a value determined by the controller based on a second heat rejection heat exchanger pressure mode; or determining, via the controller, that the pressure in the flash tank is equal to or greater than the fourth threshold and lower than a fifth threshold and controlling the opening degree of the expansion device based on fuzzy regulation; or determining, via the controller, that the pressure in the flash tank is equal to or greater than the fifth threshold and lower than a sixth threshold and controlling the opening degree of the expansion device based on a flash tank pressure regulation mode; or determining, via the controller, whether the pressure in the flash tank is equal to or greater than the sixth threshold and closing the expansion device.

9. The method according to claim 8, wherein the first heat rejection heat exchanger pressure mode comprises controlling the expansion device based on the temperature of the refrigerant in the heat rejection heat exchanger.

10. The method according to claim 8, wherein the second heat rejection heat exchanger pressure mode (HRHE_mode2) comprises controlling the expansion device based on the temperature of the refrigerant in the heat rejection heat exchanger and the pressure of the refrigerant in the flash tank.

11. The method according to claim 8, wherein the flash tank pressure regulation mode comprises controlling the expansion device based on the pressure of the refrigerant in the flash tank.

12. The method according to claim 1, wherein the refrigerant cycle comprises a by-pass line connected between the flash tank and the suction port of the compressor, wherein the by-pass line comprises a by-pass valve, and wherein the method further comprises:

determining, via the controller, that the pressure of the flash tank is lower than the second threshold and closing the by-pass valve; or determining, via the controller, that the pressure of the flash tank is equal to or greater than the second threshold and lower than a third threshold, and determining, by the controller, a value for an opening degree of the by-pass valve based on the determined flash tank pressure; or determining, via the controller, that the pressure of the flash tank is equal to or greater than the third threshold and lower than a fourth threshold, and opening the by-pass valve completely; or determining, via the controller, that the pressure of the flash tank is equal to or greater than the fourth threshold and setting an opening degree of the by-pass valve to a predetermined value.

* * * * *